US008500050B2

(12) United States Patent
Ryder

(10) Patent No.: US 8,500,050 B2
(45) Date of Patent: Aug. 6, 2013

(54) FOOD WASTE DISPOSER WITH RESTRICTED GRIND CHAMBER DISCHARGE

(75) Inventor: Jerry G. Ryder, Lake Bluff, IL (US)

(73) Assignee: Emerson Electric Co., St. Louis, MO (US)

( * ) Notice: Subject to any disclaimer, the term of this patent is extended or adjusted under 35 U.S.C. 154(b) by 17 days.

(21) Appl. No.: 13/234,207

(22) Filed: Sep. 16, 2011

(65) Prior Publication Data

US 2012/0234951 A1 Sep. 20, 2012

Related U.S. Application Data

(60) Provisional application No. 61/389,415, filed on Oct. 4, 2010.

(51) Int. Cl.
*B02C 23/36* (2006.01)

(52) U.S. Cl.
USPC ..... 241/46.013; 241/46.014; 241/46.015; 241/46.016; 241/46.08; 241/86.1; 241/89.3; 241/95

(58) Field of Classification Search
USPC ..... 241/46.013–46.016, 95, 86.1, 89.3, 241/46.08
See application file for complete search history.

(56) References Cited

U.S. PATENT DOCUMENTS

| | | | | |
|---|---|---|---|---|
| 4,082,229 | A * | 4/1978 | Boosman | 241/46.013 |
| 4,134,555 | A * | 1/1979 | Rosselet | 241/46.013 |
| 6,439,487 | B1 * | 8/2002 | Anderson et al. | 241/46.013 |
| 7,533,835 | B2 * | 5/2009 | Hanson | 241/33 |
| 7,753,297 | B2 | 7/2010 | Hanson et al. | |
| 2006/0278742 | A1 * | 12/2006 | Hanson et al. | 241/46.013 |
| 2007/0075169 | A1 * | 4/2007 | Pan et al. | 241/46.013 |
| 2007/0114310 | A1 * | 5/2007 | Berger et al. | 241/46.013 |
| 2007/0145169 | A1 * | 6/2007 | Hanson et al. | 241/46.013 |
| 2008/0116305 | A1 * | 5/2008 | Hanson et al. | 241/46.013 |
| 2008/0302891 | A1 * | 12/2008 | Anderson et al. | 241/46.014 |
| 2010/0006682 | A1 * | 1/2010 | Jara-Almonte et al. | 241/46.013 |
| 2010/0012757 | A1 * | 1/2010 | Ye et al. | 241/46.013 |

* cited by examiner

*Primary Examiner* — Dana Ross
*Assistant Examiner* — Onekki Jolly
(74) *Attorney, Agent, or Firm* — Harness, Dickey & Pierce, P.L.C.

(57) ABSTRACT

A food waste disposer has a grinding mechanism that improves fineness and speed of grinding food waste, and also controls or meters the size of the comminuted food waste particles that are discharged from the food waste disposer. It does so by utilizing a more aggressive grind ring of the grinding mechanism that includes horizontal shredder elements in addition to openings, and blocking all except the openings in a minor circumferential portion of the grind ring from discharging comminuted food waste and water to a discharge outlet. In an aspect, a resilient seal is used to seal the adapter ring to a housing of an upper end bell of the grinding section and also provide a seal for a rotating shredder plate assembly of the food waste disposer.

8 Claims, 5 Drawing Sheets

FOOD WASTE DISPOSER WITH RESTRICTED GRIND CHAMBER DISCHARGE

CROSS-REFERENCE TO RELATED APPLICATIONS

This application claims the benefit of U.S. Provisional Application No. 61/389,415, filed on Oct. 4, 2010. The entire disclosure of the above application is incorporated herein by reference.

FIELD

The present disclosure relates generally to food waste disposers, and more particularly, to grinding mechanisms for food waste disposers.

Food waste disposers are used to comminute food scraps into particles small enough to safely pass through household drain plumbing. A conventional disposer includes a food conveying section, a motor section, and a grinding section disposed between the food conveying section and the motor section. The food conveying section includes a housing that forms an inlet for receiving food waste and water. The food conveying section conveys the food waste to the grinding section, and the motor section includes a motor imparting rotational movement to a motor shaft to operate the grinding mechanism.

The grinding section in which comminution occurs typically has a rotating shredder plate with lugs and a stationary grind ring received in a housing of the grinding section. The motor turns the rotating shredder plate and the lugs force the food waste against the grind ring where it is broken down into small pieces. Once the particles are small enough to pass out of the grinding mechanism, they are flushed out into the household plumbing. Size control is primarily achieved through controlling the size of the gap through which the food particles must pass. In some cases, the housing of the grinding section and the housing of the food conveying section are integrally formed as a single housing. In other cases, they are not.

U.S. Ser. No. 11/969,380 filed Jan. 4, 2008 for a "Food Waste Disposer with Grinding Mechanism with Windowed Grind Ring" shows a prior art food waste disposer 100 having a grinding mechanism with a windowed grind ring. The entire disclosure of U.S. Ser. No. 11/969,380 is incorporated herein by reference. With reference to FIGS. 1-3 (which are FIGS. 2, 10 and 12 of U.S. Ser. No. 11/969,380 with minor changes), disposer 100 includes a food conveying section 102 and a grinding section 104, having a grinding mechanism 110, which is disposed between the food conveying section 102 and a motor section 120. The food conveying section 102 includes a housing 105 having an inlet 108 for receiving food waste and water. In an aspect, a portion of housing 105 encompasses the grinding mechanism 110. Alternatively as shown in FIG. 1, grinding section 104 may have a separate housing 111, that is mated to housing 105, that encompasses the grinding mechanism 110. The food conveying section 102 conveys the food waste to the grinding mechanism 110 of grinding section 104, and the motor section 120 includes a motor (not shown) imparting rotational movement to a motor shaft 118 to operate the grinding mechanism 110.

The grinding mechanism 110 includes a stationary grind ring 116 that is fixedly attached to an inner surface of a housing 111 of the grinding section 104, or to an adapter ring fixedly attached to an inner surface of the housing of the grinding section 104. A rotating shredder plate assembly 112 is rotated relative to the grind ring 116 by the motor shaft 118 to reduce food waste delivered by the food conveying section 102 to small pieces. The rotating shredder plate assembly may include fixed lugs, rotatable lugs, or both. When the food waste is reduced to particulate matter sufficiently small, it passes from above the shredder plate assembly 112, and along with water injected into the disposer, is discharged in a discharge area 122 in an upper end bell 124, which may be a die cast upper end bell, of grinding section 104 that is secured to an upper end of motor section 120, and then out of food waste disposer 100 through a discharge outlet 128. The discharge outlet 128 may be formed as part of a die-cast upper end bell 124. Alternatively, the discharge outlet 128 may be separately formed from plastic as part of the outer housing of the disposer. A tailpipe or drainpipe (not shown) is coupled to the discharge outlet 128.

The shredder plate assembly 112 may be made up from multiple, stacked plates or disks to provide a plurality of levels for multi-stage chopping or cutting of food waste. These stacked plates or disks may include an under cutting arrangement useful in conjunction with a "pass-through" grind ring assembly that has openings extending through the grind ring 116. FIG. 2 shows one such a grind ring 116. The grind ring 116 shown in FIG. 2 has openings or windows 130 extending therethrough, and notches or openings 132 that create teeth 134 on the grind ring 116. In other embodiments, only the windows 130 are defined in the grind ring 116. A plurality of breaker members 117 are defined by the grind ring 116, extending towards the center of the grind ring 116 to break up food waste inside the grinding mechanism 110.

FIG. 3 conceptually illustrates portions of the grinding mechanism 110 in a partial sectional view. A backing member 140 (which may be referred to herein as an adapter ring) defines cavities 142 therethrough that correspond to the openings 130, 132 through the grind ring 116, creating a tunnel-like passage 144 behind the openings 130, 132. Backing member 140 is fixedly received in housing 111 of grinding section 104 against an inner surface of housing 111. The food waste can be either broken against, or sheared over, the edges of the openings 130, 132. Once the particles are small enough to pass completely through the openings 130, 132, they enter the passage 144 behind the grind ring 116 and are carried from there by the water flow to the discharge area 122. The inside surface geometry of the backing member 140 creates the passages 144 behind the openings 130, 132 while supporting, orienting, and limiting rotation of the grind ring 116. To orient and limit rotation of the grind ring 116, the backing member 140 includes a key that is received by a key way 151 in the grind ring 116.

The fineness of the ground waste is controlled by the size of the openings 130, 132 in the grind ring 116 as seen by the food waste. The apparent opening size is affected by the rotational speed and the trajectory of the food waste into the ring.

FIG. 4 (which is FIG. 21 of U.S. Ser. No. 11/969,380 with minor changes) is a partial cut-away view of food waste disposer 400 showing a variation of food waste disposer 100. Food waste disposer 400 includes food conveying section 402 and grinding section 404 including grinding mechanism 110,' which is disposed between food conveying section 402 and a motor section (not shown). Food conveying section 402 includes a housing 406 that forms an inlet for receiving food waste and water. The food conveying section 402 conveys the food waste to the grinding mechanism 110'. Grinding section 404 includes a housing 408 having an inner surface 410. Housing 408 has a dishwasher inlet 412 affixed to inner surface 410 about an opening 416 and a dishwasher conduit 418 extending outwardly from opening 416. Housing 408 of grinding mechanism 110' is illustratively mounted to housing 406 of food conveying section 402 by an anti-vibrational mount 420. Anti-vibrational mount 420 may illustratively be molded of a thermoplastic elastomer and overmolded around an outer periphery of the bottom of housing 406 of food conveying section 402 and an inner periphery of the top of housing 408 of grinding section 404.

Illustratively, housing 408 of grinding section 404 and dishwasher conduit 418 are molded from a plastic material, such as polypropylene. They may illustratively be molded as a single piece, or as separate pieces and joined together. Housing 406 of food conveying section 402 may illustratively be molded from a plastic material, such as polypropylene Dishwasher inlet 412 may illustratively be molded of a high strength plastic material, such as nylon.

Grind ring 116 of grinding mechanism 110' is fixedly attached to inner surface 410 of housing 408 of grinding section 404. As discussed above, grind ring 116 includes windows 130 extending therethrough and notches 132 that create teeth 134 on grind ring 116, as shown in FIG. 2. Also as discussed above, in other embodiments, grind ring 116 has windows 130 but not notches 132 or teeth 134.

Grinding section 404 also includes cavities 142' therein outboard of openings 130, 132. Instead of backing member 140 having the cavities 142 that form the tunnel-like passages 144 as discussed above, inner surface 410 of housing 408 includes cavities 142' therein that correspond to the openings 130, 132, with cavities 142' forming the tunnel like passages 144' (FIG. 5 which is FIG. 22 of U.S. Ser. No. 11/969,380 with minor changes). As in the case of backing member 140, cavities 142' are disposed outboard of the openings 130, 132.

SUMMARY

In accordance with an aspect of the present disclosure, a food waste disposer has a grinding mechanism that improves fineness and speed of grinding food waste, and also controls or meters the size of the comminuted food waste particles that are discharged from the food waste disposer. It does so by utilizing a more aggressive grind ring of the grinding mechanism that includes horizontal shredder elements in addition to openings, and blocking all except the openings in a minor circumferential portion of the grind ring from discharging comminuted food waste and water to a discharge outlet.

In an aspect, a major circumferential portion of the grind ring where the openings are blocked is approximately seventy percent (70%) of the circumference of the grind ring and the minor circumferential portion where the openings are not blocked is approximately thirty percent (30%) of the circumference of the grind ring.

In an aspect, a resilient seal is used to seal the adapter ring to a housing of an upper end bell of the grinding section and also provide a seal for a rotating shredder plate assembly of the food waste disposer.

BRIEF DESCRIPTION OF THE DRAWINGS

Other objects and advantages of the invention will become apparent upon reading the following detailed description and upon reference to the drawings in which.

Figure 1:
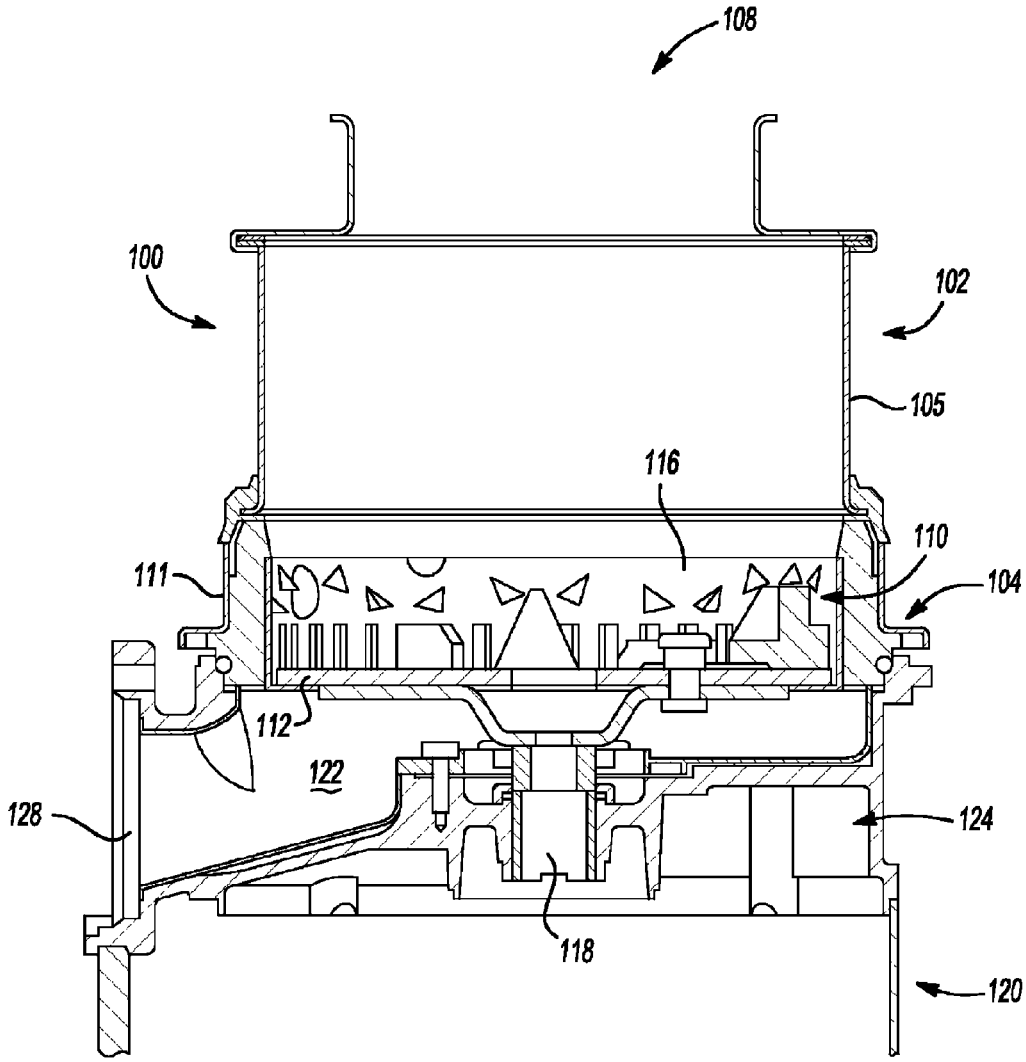
Fig-1 PRIOR ART
FIG. 1 shows a prior art food waste disposer and components thereof.
Figure 2:
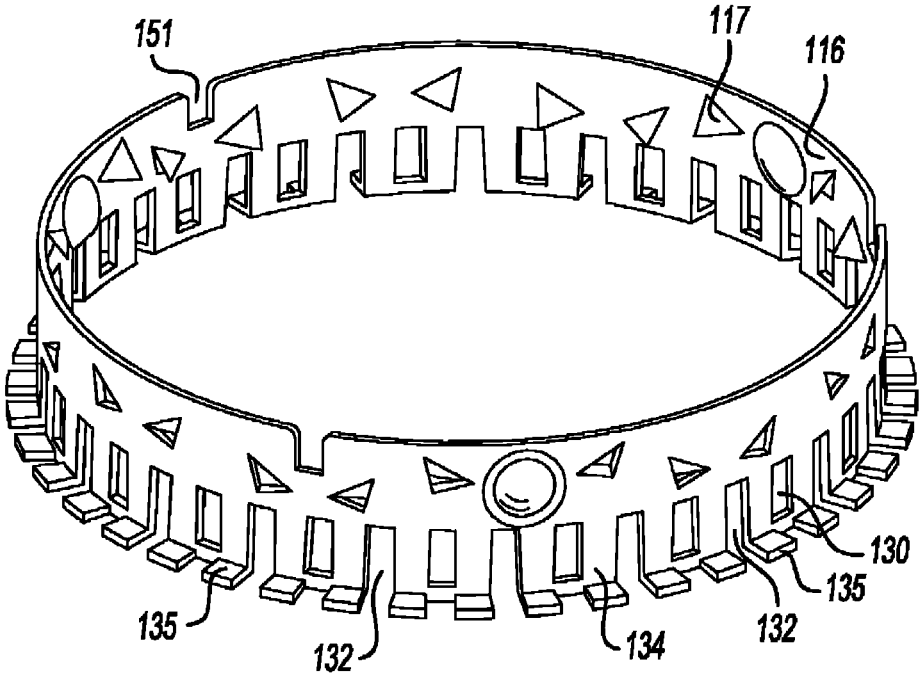
Fig-2 PRIOR ART
FIG. 2 shows a stationary grind ring of the food waste disposer of FIG. 1.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. It should be understood that throughout the drawings, corresponding reference numerals indicate like or corresponding parts and features.

Figure 6:
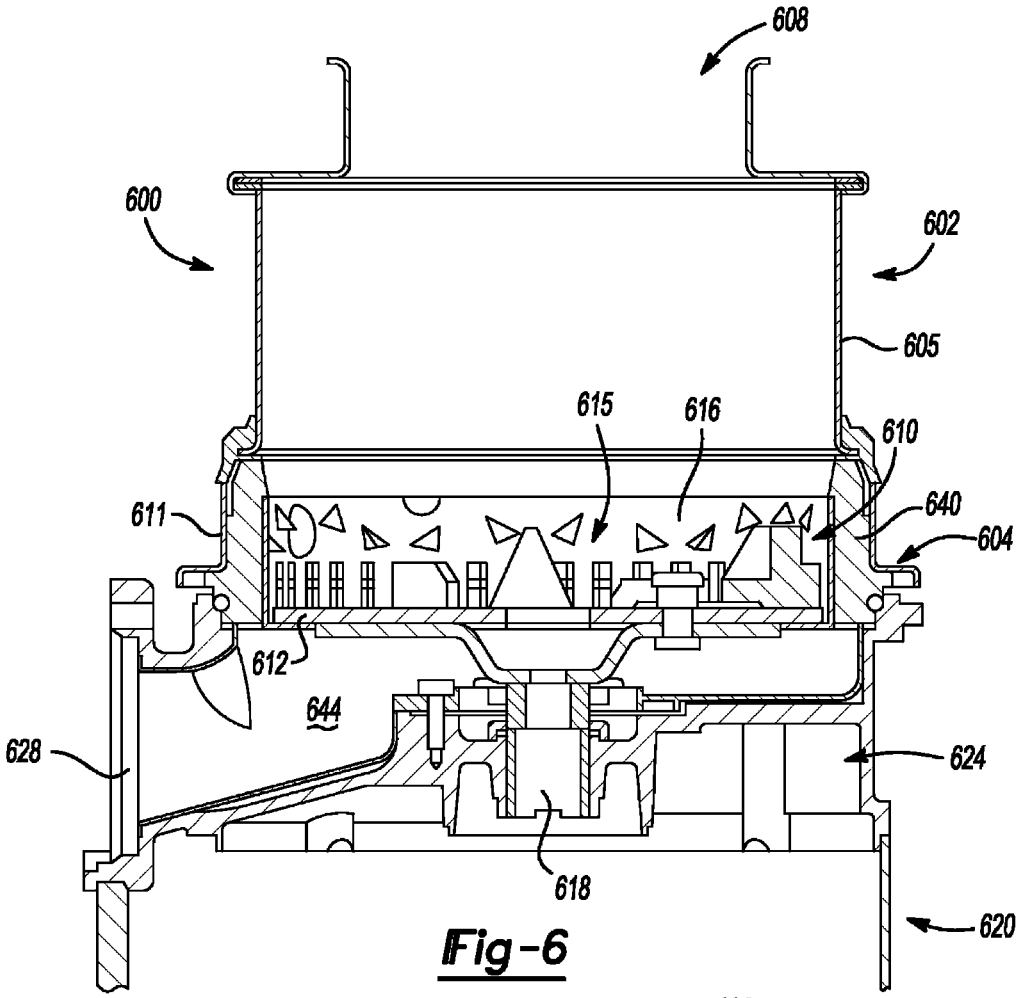
FIG. 6 shows a food waste disposer having an aggressive stationary grind ring in accordance with an aspect of the present disclosure.

FIG. 6 illustrates portions of an exemplary food waste disposer 600 embodying aspects of the present disclosure. The food waste disposer 600 includes a food conveying section 602 and a central grinding section 604, which is disposed between the food conveying section 602 and a motor section 620. The food conveying section 602 includes a housing 605 having an inlet 608 for receiving food waste and water. The food conveying section 602 conveys the food waste to the grinding section 604, and the motor section 620 includes a motor (not shown) imparting rotational movement to a motor shaft 618 to operate grinding mechanism 610 of grinding section 604.

The grinding mechanism 610 includes a stationary grind ring 616 that is fixedly attached to an inner surface of an adapter ring 640 of grinding section 604 that is fixedly attached to an inner surface of housing 611 of the grinding section 604. Grinding section 604 has a grind chamber 615 surrounded by grind ring 616. In alternative embodiment, grinding section 604 does not have adapter ring 640 and grind ring 616 is fixedly attached to the inner surface of housing 611. A rotating shredder plate assembly 612 is rotated relative to the grind ring 616 by the motor shaft 618 to reduce food waste delivered by the food conveying section 602 to small pieces. When the food waste is reduced to particulate matter sufficiently small, it passes from above the shredder plate assembly 612, and along with water injected into the disposer 600, is discharged through a discharge outlet 628.

Food waste disposer 600 differs from prior art food waste disposers such as those described in the Background Section of the present application particularly with regard to grinding section 604. Grind ring 616 is an aggressive grind ring, as discussed in more detail below. Also, openings in a major circumferential portion of grind ring 616 are blocked, so that comminuted food waste and water can exit grinding section 604 only through openings in a minor circumferential portion of the of grind ring 616. In an aspect, the major circumferential portion where the openings are blocked extends around approximately seventy percent (70%) of the circumference of grind ring 616 and the minor circumferential portion of the grind ring where the openings are not blocked extends around the remaining approximately thirty percent (30%) of the circumference of the grind ring. In an aspect, the openings in the minor portion of the grind ring 616 are sized to achieve a desired fineness of grind of the comminuted food waste before the comminuted food waste is discharged from the food waste disposer through discharge outlet 628.

Figure 7:
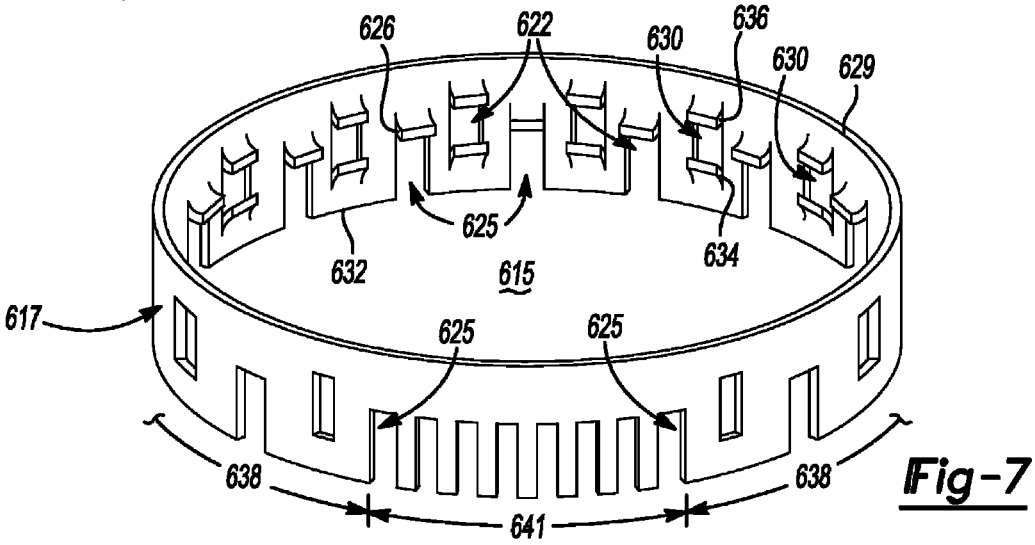
FIG. 7 shows the stationary grind ring of the food waste disposer of FIG. 6.
Figure 8:
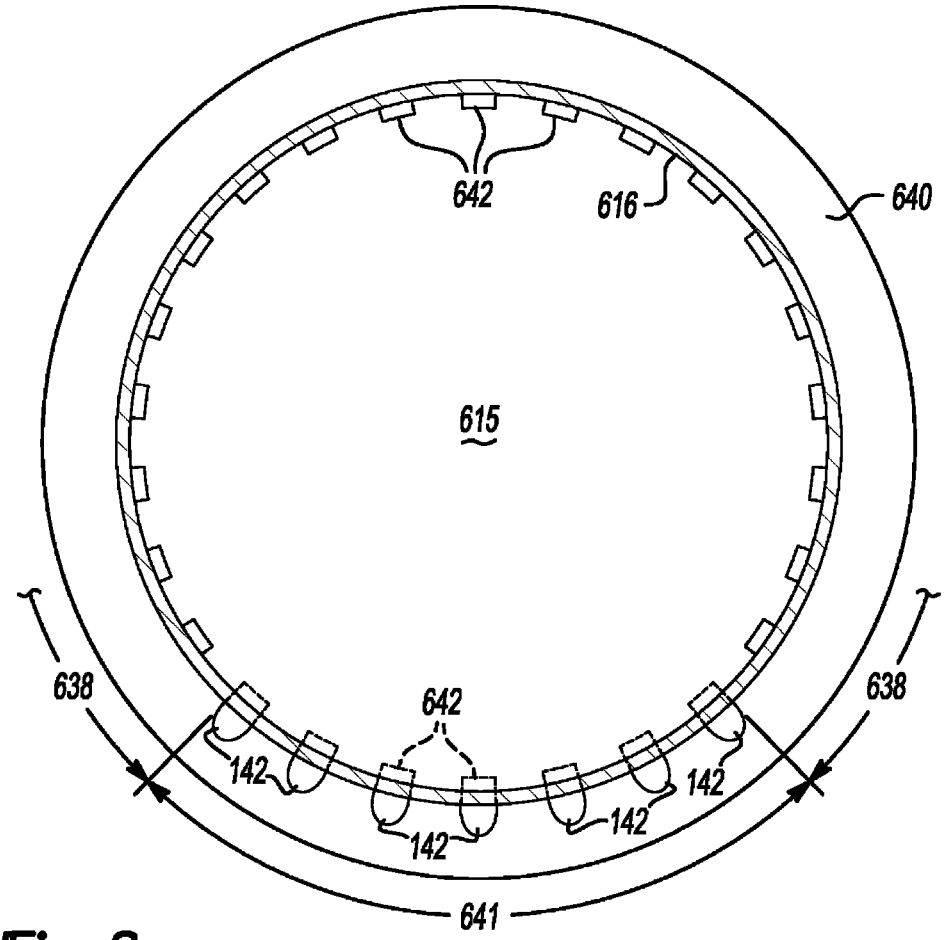
FIG. 8 shows the stationary grind ring of the food waste disposer of FIG. 6 received in an adapter ring.

With reference to FIGS. 6-8, grinding mechanism 610 of food waste disposer 600 in accordance with an aspect of the present disclosure is described in more detail. Grind ring 616 of grinding mechanism 610 includes a plurality of openings 622 in grind ring 616 in spaced relation to each other around a circumference of the grind 616. In an aspect, openings 622 include long openings 625 that extend upwardly from a lower edge 632 of grind ring 616 with upper edges 626 that are spaced from an upper edge 629 of grind ring 616 and mid-openings 630 that extend above and below a mid-point of grind ring 616, which is a point equidistant from the upper edge 629 and lower edge 632 of grind ring 616. Mid-openings 630 have lower edges 634 spaced from lower edge 632 of grind ring 616 and upper edges 636 spaced from upper edge 629 of grind ring 616. In an aspect, long openings 625 and mid-openings 630 alternate around a major circumferential portion 638 of grind ring 616 and a plurality of long openings 625 are disposed adjacent each other in grind ring 616 around a minor circumferential portion 641 of grind ring 616 without any mid-openings 630 disposed therebetween. The major circumferential portion 638 and minor circumferential portion 641 are each arcuate sections of grind ring 616. The openings 622 in the major circumferential portion 638 are blocked and the openings 622 in the minor circumferential portion 641 are not blocked. In an aspect, long openings 625 and mid-openings 630 are illustratively rectangular openings. It should be understood that they can have other shapes, such as square, triangular, trapezoidal, or circular. The major circumferential portion 638 of grind ring 616 is illustratively blocked on an outer side 617 of grind ring 616 to block the openings in major circumferential portion 638.

Horizontal shredder elements 642 extend into grind chamber 615 radially inwardly from grind ring 616, approximately perpendicular to grind ring 616. Each shredder element 642 may illustratively be stamped from grind ring 616 such that it is a rectangularly shaped tooth joined at one end to grind ring 616 at upper edge 626 of a long window 625 or to an upper edge 636 or lower edge 634 of a mid-window 630, as applicable, and bent inwardly from grind ring 616 so that it extends into grind chamber 615. In an aspect, grind ring 616 has horizontal shredder elements 642 around the major circumferential portion 638 of grind ring 616 (but not the minor circumferential portion 641) with each long window 625 having a horizontal shredder element 642 extending inwardly from its upper edge 626 and each mid-window 630 having horizontal shredder elements 642 extending inwardly from its upper and lower edges 636, 634, respectively. Grind ring 616 also has horizontal shredder elements 642 around the minor circumferential portion 641 (shown in phantom in FIG. 8) of grind ring 616 with each long window 625 in minor circumferential portion 641 having a horizontal shredder element 642 extending inwardly from its upper edge 626.

Figure 3:
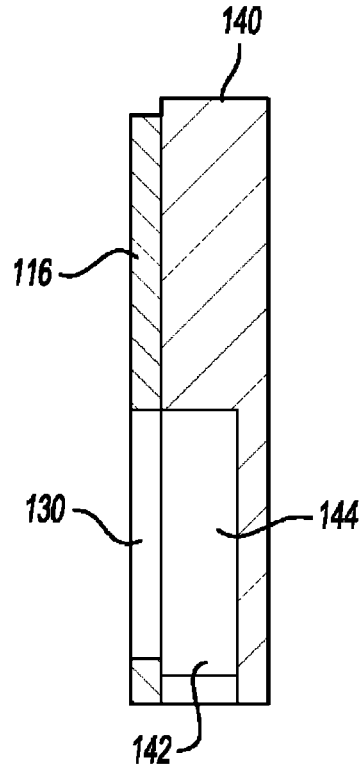
Fig-3 PRIOR ART
FIG. 3 shows a backing member in which the stationary grind ring of FIG. 2 is received.
Figure 4:
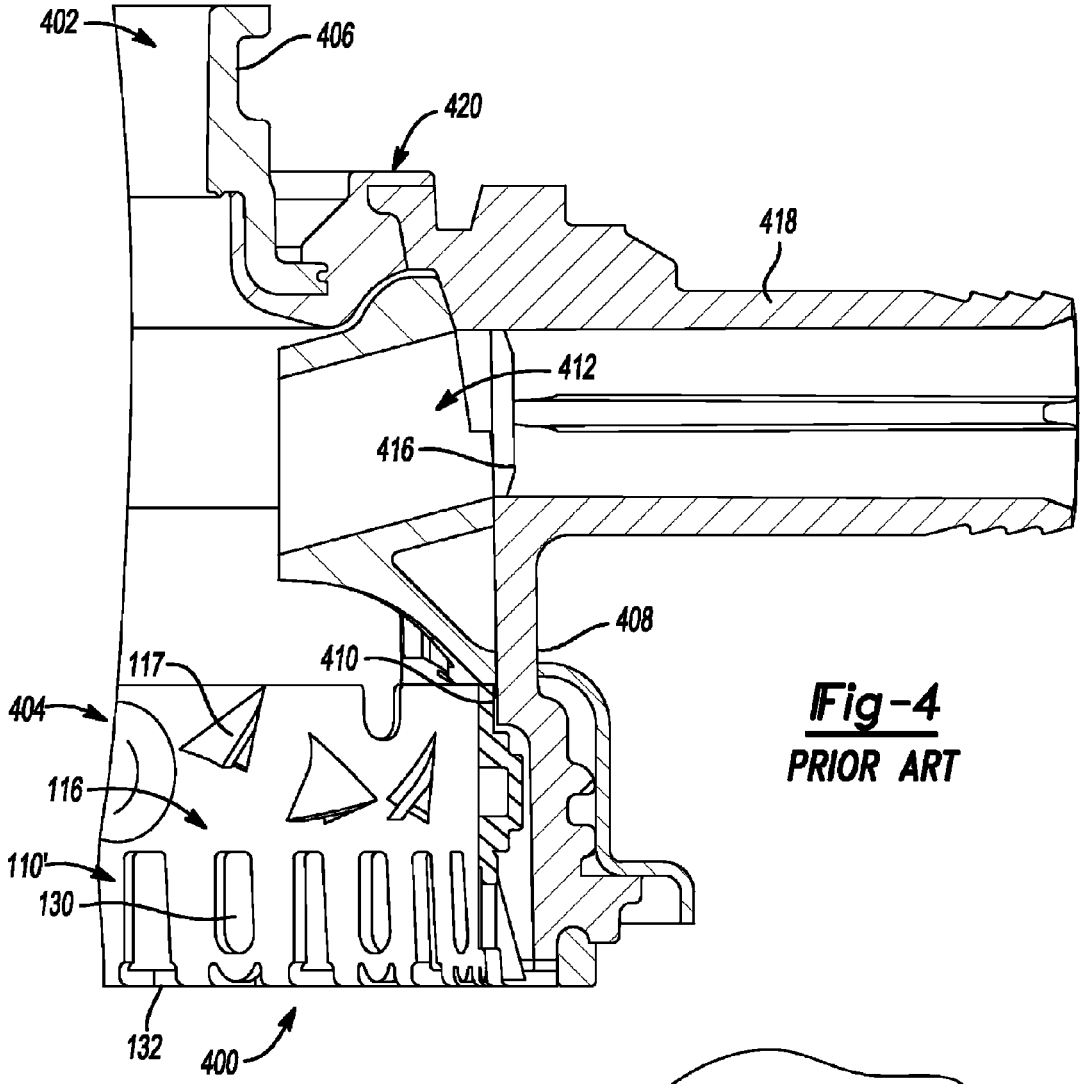
Fig-4 PRIOR ART
FIGS. 4 and 5 show a prior art variation of the food waste disposer of FIG. 1.
Figure 5:
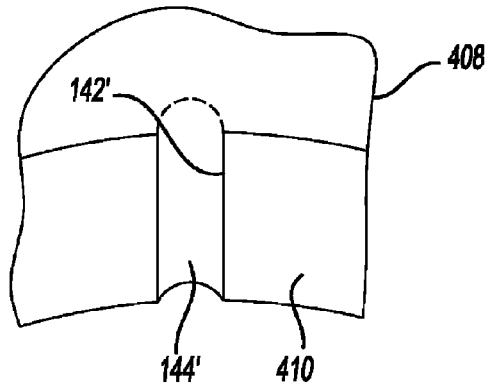
Fig-5 PRIOR ART

As discussed, the openings 622 in the major circumferential portion 638 are blocked so that comminuted food waste and water only exit grind chamber 615 through the openings 622 in the minor circumferential portion 641, which in the embodiment shown in FIG. 7, are long openings 625. In an aspect, minor circumferential portion 641 is disposed directly above the discharge area 644 (FIG. 6) in the upper end bell 624 of grinding section 604, to which discharge outlet 628 is coupled. In an aspect, when grind ring 616 is received in adapter ring 640, adapter ring 640 is solid behind the openings 622 in major circumferential portion 638, thus blocking them, but has a relieved portion (or portions) behind the openings 622 in minor circumferential portion 641. Illustratively, adapter ring 640 may have cavities such as cavities 142 (FIG. 3) therein that correspond to openings 622 in minor circumferential portion 641 and which create a tunnel-like, passage, such as tunnel-like passage 144 (FIG. 3) behind the openings 622 in minor portion 641. The food waste is broken against, or sheared over, the edges of openings 622 and also shredded by shredder elements 642 to comminute the food waste. The comminuted food waste and water then pass through the openings 622 in the minor circumferential portion 641, through the tunnel-like passage therebehind to fall beneath the shredder plate assembly 612 and flow out of food waste disposer 600 through discharge outlet 628. Alternatively, instead of individual cavities corresponding to openings 622 in the minor circumferential portion 641, a portion of adapter ring 640 corresponding to minor circumferential portion 641 can be relieved to provide a space behind the openings 622 in minor circumferential portion 641.

It should be understood that grind ring 616 can be mounted directly in housing 611 of grinding section 604 without the use of adapter ring 640. In this aspect, housing 611 would include the cavities corresponding to the openings 622 in minor circumferential portion 641, or a relieved portion corresponding to the minor circumferential portion 641 of grind ring 616. Housing 611 would block the openings in major circumferential portion 638, such as having a solid wall abutting outside 617 of grind ring 616 around major circumferential portion 638.

The openings 622 in minor portion 641 are sized to provide the desired size of comminuted food waste particles to be discharged from food waste disposer 600.

The above described grinding mechanism improves fineness and speed of grinding food waste. It also controls or meters the size of the comminuted food waste particles that are discharged from food waste disposer 600 to reduce the possibility of downstream plumbing blockages. It does so by utilizing the more aggressive grind ring 616 that includes horizontal shredder elements 642 in addition to openings 622, and blocking all except the openings 622 in the minor portion 641 from discharging comminuted food waste and water to discharge outlet 628. The food waste will recirculate in grind chamber 615 until it is comminuted to a particle size that will pass through openings 622 in minor portion 641 of the circumference of the grind ring 616. By thus limiting the particle size of the comminuted food waste that can be discharged, and the rate of fluid discharge (by blocking all except the minor portion 641), grinding of the food waste can be achieved more quickly and with less consumption of water.

In an aspect, the major circumferential portion 638 of the grind ring 616 extends around approximately seventy percent (70%) of the circumference of grind ring 616 and the minor circumferential portion 641 extends around the remaining approximately thirty percent (30%) of the circumference of grind ring 616.

Figure 9:
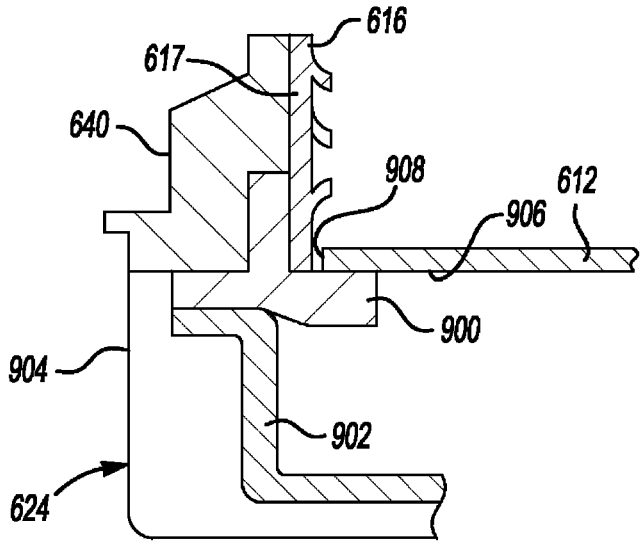
FIG. 9 shows a resilient seal that seals the adapter ring of FIG. 8 to a housing of an upper end bell of grinding section and also provides a seal for a rotating shredder plate assembly of the food waste disposer of FIG. 6.

With reference to FIG. 9, in an aspect, a resilient seal 900 may be used to seal adapter ring 640 to a housing 904 of the upper end bell 624 of grinding section 604, illustratively to a liner 902 of the upper end bell 624, and also provide a seal for the rotating shredder plate assembly 612. Seal 900 is configured to seal around the major circumferential portion 638 of the grind ring 616 but is omitted, or has a relieved portion, around the minor circumferential portion 641 of grind ring 616. Seal 900 is disposed around at least a lower portion of the outside of grind ring 616, between a bottom of adapter ring 640 and the upper end bell 624, and along a bottom 906 of an outer edge 908 of the rotating shredder plate of the rotating shredder plate assembly 612. Resilient seal 900 may be made of rubber or a polymeric material, such as TPE.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention.

What is claimed is:

1. A food waste disposer comprising:

a food conveying section, a motor section and a grinding section, the grinding section disposed between the food conveying section and the motor section, the food conveying section conveying food waste to the grinding section;

the grinding section including a grind mechanism, the grind mechanism including a stationary grind ring and a rotating shredder plate assembly; and the stationary grinding ring comprising an aggressive grind ring that includes horizontal shredder elements and openings therein in spaced relationship to each other around a circumference of the stationary grind, the openings in a major circumferential portion of the stationary grind ring blocked so that comminuted food waste can exit the grinding section only through the openings in a minor circumferential portion of the stationary grind ring.

2. The food waste disposer of claim 1 wherein the major circumferential portion extends around approximately seventy percent of the circumference of the stationary grind ring and the minor circumferential portion extends around a remaining approximately thirty percent of the circumference of the stationary grind ring.

3. The food waste disposer of claim 1 wherein the openings include long openings that extend upwardly from a lower edge of the stationary grind ring with upper edges that are spaced from an upper edge of the stationary grind ring and mid-openings that extend above and below a mid-point of the stationary grind ring with lower edges spaced from a lower edge of the stationary grind ring and upper edges spaced from the upper edge of the stationary grind ring.

4. The food waste disposer of claim 3 wherein a plurality of the long openings and the mid-openings alternate around the major circumferential portion and another plurality of the long openings are disposed adjacent each other around the minor circumferential portion of the stationary grind ring without any mid-openings disposed therebetween.

5. The food waste disposer of claim 3 wherein the horizontal shredder elements extend radially inwardly from the upper edges of the long and mid-openings and from lower edges of the mid-openings.

6. The food waste disposer of claim 1 wherein the rotating shredder plate assembly includes a rotating shredder plate, and further including an adapter ring in which the stationary grind ring is received and a resilient seal that seals the adapter ring to an upper end bell of the grinding section and the rotating shredder plate, the resilient seal disposed around a lower portion of an outside of the stationary grind ring between a bottom of the adapter ring and a top of the upper end bell and along a bottom of an outer edge of the rotating shredder plate.

7. The food waste disposer of claim 6 wherein the adapter ring is solid behind the openings in the major circumferential portion and blocks those openings.

8. The food waste disposer of claim 1 wherein the horizontal shredder elements extending radially inwardly from at least upper edges of the openings.

* * * * *